US007389876B2

(12) United States Patent
Hong et al.

(10) Patent No.: US 7,389,876 B2
(45) Date of Patent: Jun. 24, 2008

(54) TRY-ON PACKAGE FOR ARTIFICIAL FINGERNAILS

(75) Inventors: Sung Hong, Fresh Meadows, NY (US); Grace Tallon, New York, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 325 days.

(21) Appl. No.: 10/987,821

(22) Filed: Nov. 12, 2004

(65) Prior Publication Data

US 2005/0115868 A1 Jun. 2, 2005

Related U.S. Application Data

(63) Continuation-in-part of application No. 10/665,753, filed on Sep. 19, 2003.

(51) Int. Cl.
*B65D 77/00* (2006.01)

(52) U.S. Cl. ..... 206/581; 206/823; 206/815

(58) Field of Classification Search ..... 206/581, 206/823, 815, 775, 776, 782
See application file for complete search history.

(56) References Cited

U.S. PATENT DOCUMENTS

| | | | | | |
|---|---|---|---|---|---|
| 3,485,344 | A | * | 12/1969 | Aylott | 206/784 |
| 3,982,551 | A | * | 9/1976 | Bartolucci | 132/73 |
| 4,106,614 | A | * | 8/1978 | Aylott | 206/581 |
| 4,140,139 | A | * | 2/1979 | Aylott | 132/73 |
| 5,409,105 | A | | 4/1995 | Appelbaum et al. | |
| 5,791,482 | A | * | 8/1998 | Murphy et al. | 206/581 |
| 5,816,408 | A | | 10/1998 | Indelicato | |

FOREIGN PATENT DOCUMENTS

WO WO 98/56682 * 12/1998

* cited by examiner

*Primary Examiner*—Jacob K Ackun, Jr.
(74) *Attorney, Agent, or Firm*—Cohen Pontani Lieberman & Pavane LLP

(57) ABSTRACT

Artificial fingernail packages are provided that contain a collection of artificial fingernails, that enable a potential user to easily inspect the size, shape and other features of the included artificial fingernails, to compare the features of the included artificial fingernails to the user's natural fingernails, and to simulate trying on one or more of the artificial fingernails without opening the package.

8 Claims, 6 Drawing Sheets

TRY-ON PACKAGE FOR ARTIFICIAL FINGERNAILS

RELATED APPLICATIONS

This is a continuation in-part of application Ser. No. 10/665,753, filed Sep. 19, 2003, priority to which is claimed under 35 U.S.C. §120 and the specification and disclosure of which are hereby incorporated by reference herein in their entirety.

BACKGROUND OF THE INVENTION

Field of the Invention

The present invention relates to artificial fingernails. More particularly, this invention relates to packaging for artificial fingernails, wherein the package, or kit, allows a potential purchaser to see the product fingernails clearly while the fingernails remain in the package prior to purchase. It is a further purpose of this invention to provide a package for the distribution, retail display and retail sale of artificial fingernails that provides an easy way for the consumer to sample or "try on" the artificial fingernails contained in the package while the fingernails remain in the package prior to purchase.

Artificial fingernails are generally used for the purpose of cosmetic enhancement. They may be applied by a technician or manicurist in a fingernail salon, or may be purchased in a variety of different packages at retail stores and applied directly by the wearer. Users of artificial fingernails include, for example, individuals seeking to hide a cracked or chipped natural fingernail, or those who simply find it difficult to grow healthy natural nails to the length they desire. In addition, artificial fingernails are often employed by individuals seeking to deter a habit of nail biting, and by those who simply desire to have low maintenance nails that are easy to apply and remove in response to changing daily needs.

Currently, there are many different types of artificial fingernails ("nails") that are well known. Different types of artificial nails include, for example, sculptured nails, acrylic nails, gel nails, nail wraps, pre-glued self-adhesive nails, nail tips and full-cover nails, with each type of nail having different benefits and drawbacks that are also generally well known.

In order to maximize comfort, ease of application, and durability on the wearer's finger, it is desirable that the artificial fingernails ("nails") to be used fit a user's natural fingernails properly. Given this need for proper fit, nails are produced and generally available in a variety of different sizes, shapes and styles to match the individual needs of a user. Nevertheless, the nails that a user may find in available packaging are often not adequate to provide the user with a properly-fitting nail for each of the user's natural fingernails.

Traditionally, packages have been sold containing ten or more nails. The nails sold in these conventional retail packages generally vary in size (e.g., width), and there are typically multiple nails of each size so that a user may preferably find in the package a nail of proper size for each natural fingernail. Among the nails of a particular size, however, the nails are typically identical in shape.

Given that a user's natural fingernails are likely to vary not only in size but also in shape, the collection of nails provided in such conventional artificial fingernail packages may not provide the wearer with a proper-fitting nail for each finger. Even in instances where there is some variation in shape among the nails in a package as the nails vary in size, the relatively-uniform shape available for each of the sizes may not provide a satisfactory fit for each of the user's natural fingernails. As a result, one or more of the user's natural fingernails may be left without a proper-fitting artificial nail, forcing the user either to apply improperly-fitting nails to some of her natural fingernails, or to purchase a separate package of artificial fingernails containing nails having different shapes for a given size.

Another problem associated with conventional packages for nails is that they generally include a plurality of loosely-contained nails, or nails attached to a sprue, such that various features (e.g., size and shape) of the nails are hidden from the consumer prior to the opening of the package. As a result, consumers of artificial fingernails cannot compare the size and shape of the included nails in a conventional package to the size and shape of the user's natural fingernails, and thus cannot determine prior to purchasing and opening the package whether or not the nails will fit properly. Consequently, potential users often have no choice but to purchase the package containing the nails before the nails can be adequately inspected (e.g., compared to the various sizes and shapes of the user's natural fingernails). Often, this results in a user purchasing nails that are not suitable given the sizes and shapes of the user's natural fingernails.

In view of the foregoing, it would be desirable to provide packaging for nails that is capable of storing and displaying a collection of individual nails of varying size and shape such that each of a user's natural fingernails may be lifted with an artificial fingernail of the right size and shape.

It would also be desirable to provide packaging for artificial fingernails that includes nails having, for each nail size, a variety of nail shapes.

It would also be desirable to provide packaging for artificial fingernails that allows a user to examine the features (e.g., color, size and shape) of one or more of the included nails and to optionally compare such features to the features of the user's natural fingernails.

In particular, it would be desirable to provide a user with an artificial fingernail package that allows the user to "try on" one or more of the nails without removing any of the nails from the package.

SUMMARY OF THE INVENTION

The present invention provides packaging for nails that allows a user to easily and effectively examine and compare various features (e.g., color, size and shape) of one or more of the nails included in the package to the user's natural fingernails.

The present invention also provides packaging for artificial fingernails that allows a consumer to try on, prior to opening the package, one or more of the nails in the package to evaluate fit, size, shape and color of one or more nails as in would appear on the wearer's finger.

In accordance with these and other objects of the present invention, a package for artificial fingernails is provided that permits a user to easily and effectively examine and compare several features of the included nails to determine whether they are well suited for the user's natural fingernails. For example, one or more of the nails included in the package may be placed behind a transparent portion of the package in a manner that allows the user to easily view and identify the size, shape and color of these nails, and thus, to easily compare the features of the included nails with the features of the user's natural fingernails.

Furthermore, for example, one or more of the nails in the package may be suspended in a packaging frame adjacent to an orifice into which the user may stick a finger so that it appears that the nail adjacent to the orifice has been affixed to the user's natural nail.

The outermost portion of the package is typically a box. The front of the box has a relatively large opening that allows the consumer to see into the area where the artificial fingernails in the package are contained within the packaging frame. The opening on the front of the box may be merely a hole in the cardboard or other material of which the box is made, or may be covered by a transparent film of polymeric or other material.

Inside of the box is disposed a molded plastic packaging frame, which is capable of holding the fingernails that are packaged for sale in the box. The packaging frame is designed to, among other things, hold the fingernails within the box in such a way that the fingernails are visible through the opening in the front of the box. The packaging frame will preferably contain some spaces in which individual fingernails may be placed so that the consumer looking at the front of the package sees the top of the fingernails, and also some spaces that are orientated in such a way that the consumer looking at the front of the package can see one or more fingernails within these spaces from an end-on perspective.

Additionally, the packaging frame is provided with a try-on display structure that holds one or more of the artificial fingernails in an orientation such that the consumer, when looking through the opening on the front side of the box, is able to see the top of the artificial fingernail, and such that the artificial fingernail, when the consumer inserts her finger into a properly-located orifice in the box, appears to be attached to the consumer's natural fingernail.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings.

The above and other features of the present invention, its nature and various advantages will be more apparent upon consideration of the following detailed description, taken in conjunction with the accompanying drawings, in which like reference characters refer to like parts throughout, and in which.

DETAILED DESCRIPTION OF THE PREFERRED EMBODIMENTS

Figure 1:
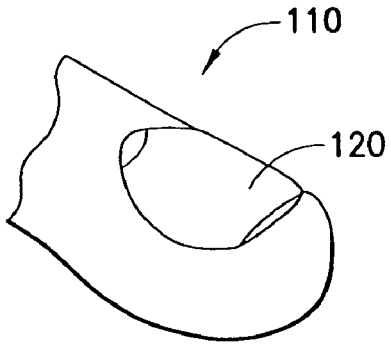
FIG. 1 shows a three dimensional perspective view of a portion of a user's finger including the natural fingernail.
Figure 2:
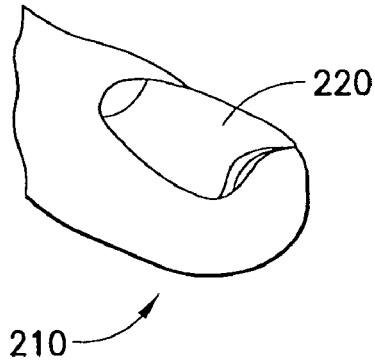
FIG. 2 shows another three dimensional perspective view of a portion of a user's finger including the natural fingernail.

FIGS. 1 and 2 show portions of two fingers 110 and 210 which respectively correspond, for example, to the middle and ring fingers of the user. Finger portion 110 includes a natural fingernail 120, while finger portion 210 includes another natural fingernail 220. Persons skilled in the art will appreciate that, although not shown in FIG. 1 or 2, the user's natural fingernails 120 and 220 may have tips extending beyond the edge of the respective fingers 110 and 210.

It is well known that the shape and/or size of an individual's natural fingernails can vary from one finger to another (as illustrated by FIGS. 1 and 2). For example, natural fingernail 120 is approximately equal in size (i.e., has similar surface area) to natural fingernail 220, although it is not as curved. As explained above, the differences in size and shape between different natural fingernails of a user necessitate artificial fingernails of similarly varying size and shape to ensure a proper fit for each of the user's natural fingernails.

Figure 3:
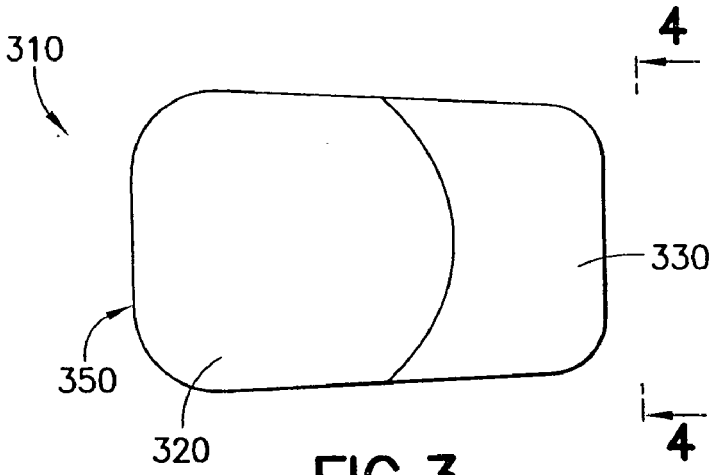
FIG. 3 shows a top view of a conventional full-cover artificial fingernail.

FIG. 3 shows a conventional full-cover artificial nail 310, which is similar in design to one that may be applied to either natural fingernail 120 or natural fingernail 220. Artificial nail 310 is preferably molded from a polymer such as ABS plastic, or otherwise manufactured by any of the conventional means well known in the art for the manufacture of artificial fingernails. Materials other than ABS plastic may also be used.

Artificial nail 310 comprises a nail bed portion 320 and a nail tip portion 330. To apply an artificial nail such as nail 310 to a natural fingernail, such as natural fingernail 120 of finger 110 shown in FIG. 1, an adhesive (not shown) such as ethylcyanoacrylate is applied to the bed portion of the natural fingernail 120 in a conventional manner. Afterwards, but before the adhesive has solidified, the artificial nail 310 is placed on top of the natural fingernail 120. If the natural fingernail 120 were to have a tip portion, then the tip portion would simply extend out under the tip portion 330 of artificial nail 310. Applied in this manner, artificial nail 310 is applied over natural fingernail 120 and resembles a natural nail. Preferably, if not similarly pre-treated prior to its application, an artificial nail 310 is coated after application with a top coat of transparent sealer in order to protect the coloring of the artificial nail 310.

To better understand the detrimental effects that improperly-fitting artificial fingernails may have on a user, and how the packaging in accordance with the principles of the present invention substantially reduces such effects, various descriptive terms for artificial fingernails (e.g., artificial nail 310) will now be explained.

Figure 4:
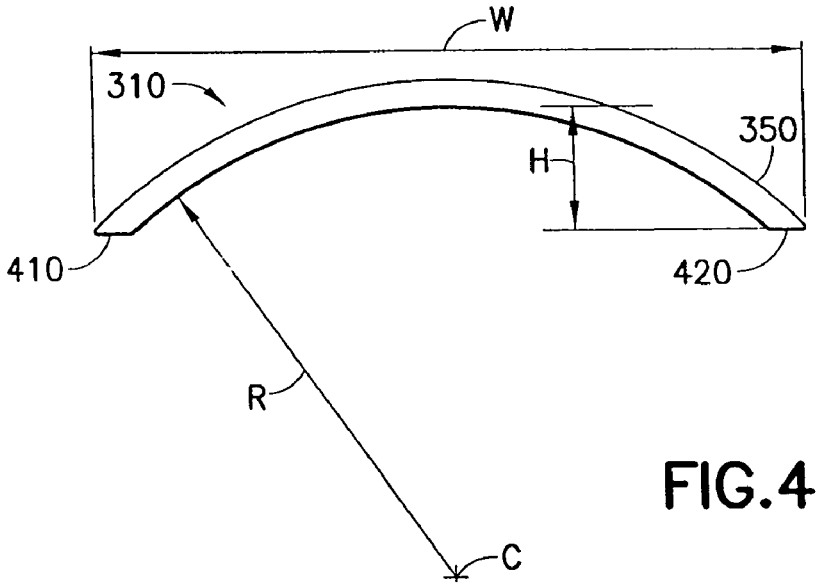
FIG. 4 is a sectional view of the full-cover artificial fingernail of FIG. 3, taken along line 4-4.

FIG. 4 is a slightly enlarged, sectional view of artificial nail 310, taken along line 4-4 of FIG. 3. In particular, FIG. 4 shows the c-curve of artificial nail 310, which is the curve that one sees when looking at the cross-section of artificial nail 310 while looking at the artificial nail 310 from beyond the nail tip portion 330 and toward the cuticle end 350 of the artificial nail 310. As shown in FIG. 4, artificial nail 310 has a particular width UV equal to the straight-line distance from first artificial nail side edge 410 to second artificial nail side edge 420. Artificial nail 310 also has a particular radius of curvature R equal to the distance from the surface of artificial nail 310 to the location of the center of curvature C of artificial nail 310. If the curvature of the artificial nail does not define a segment of a circle, the radius of curvature R may be defined as the length of a line segment extending perpendicularly from the surface of artificial nail 310 at one side edge to the point C where that line segment intersects a line segment that extends perpendicularly from the surface of artificial nail 310 at the other side edge. Finally, the arch height H of artificial nail 310 refers to the shortest distance from the surface of the artificial nail 310 at the middle of the c-curve to the plane that intersects the side edges 410 and 420 of the artificial nail 310.

Similar to artificial nail 310, each of a user's natural fingernails also has a specific width W, radius of curvature R and arch height H. Referring back to FIGS. 1 and 2, persons skilled in the art will appreciate that natural fingernail 120 has approximately the same width W as natural fingernail 220. The radius of curvature of natural fingernail 120 is, however, larger than the radius of curvature of natural fingernail 220, and consequently, the arch height of natural fingernail 120 is less than the arch height of natural fingernail 220.

While known packages for artificial fingernails seek to accommodate variations in the size (e.g., width) of a user's different natural fingernails, they do not accommodate for variations in shape. That is, if two fingernails in a conventional artificial fingernail package have the same width W, they also necessarily have the same radius of curvature R, and thus, the same arch height H. As a result, conventional packages do not always contain a nail of matching size and shape for each of a user's natural fingernails. Such discrepancy in shape likely results in difficulty in applying the nails, discomfort for the user, and unwanted lift-off of the nails from the user's natural nails, thereby reducing the life of the artificial nails being used.

In order to reduce the likelihood that such discrepancies in shape between a user's natural fingernails and the artificial nails to be applied will exist, therefore, the present invention provides artificial fingernail packages that may include nails having not only different widths, but also different shapes (e.g., arch heights). For example, a package for artificial nails in accordance with the principles of the present invention may include nails having conventional arch heights and nails having smaller arch heights such that for an individual nail of conventional arch height in the package there is a corresponding nail having substantially the same width but an arch height from 5% to 20% less than the arch height of the nail with conventional arch height. Such nails, which have smaller arch heights falling within these parameters, are referred to as low-arch artificial nails.

Alternatively, the packages in accordance with the principles of the present invention may instead include nails having conventional arch heights and nails having larger arch heights such that for an individual nail of conventional arch height in the package there is a corresponding nail having substantially the same width but an arch height from 5% to 20% greater than the arch height of the nail with conventional arch height. Such nails, which have larger arch heights failing wherein these parameters, are referred to as high-arch nails.

Accordingly, the artificial fingernail packages in accordance with the principles of the present invention are designed to contain artificial nails having a variety of different widths, and preferably at least two different arch heights for each available width. Persons skilled in the art will appreciate that the number of different arch heights provided for a given width may vary among widths (e.g., based on the estimated needs of prospective users) without departing from the spirit of the present invention. It should also be understood that a package according to the present invention may contain any combination of high-arch artificial nails, low-arch artificial nails, and artificial nails having conventional arch height.

Accordingly, the artificial nail packages in accordance with the principles of the present invention enable a user to select a particular artificial nail package that contains, for example, nails having arch heights that correspond most closely to the various shapes of the user's natural fingernails. In this manner, the likelihood that each of the customer's fingernails will be well-fitted with an artificial fingernail from packages according to the principles of the present invention is substantially increased.

Figure 5:
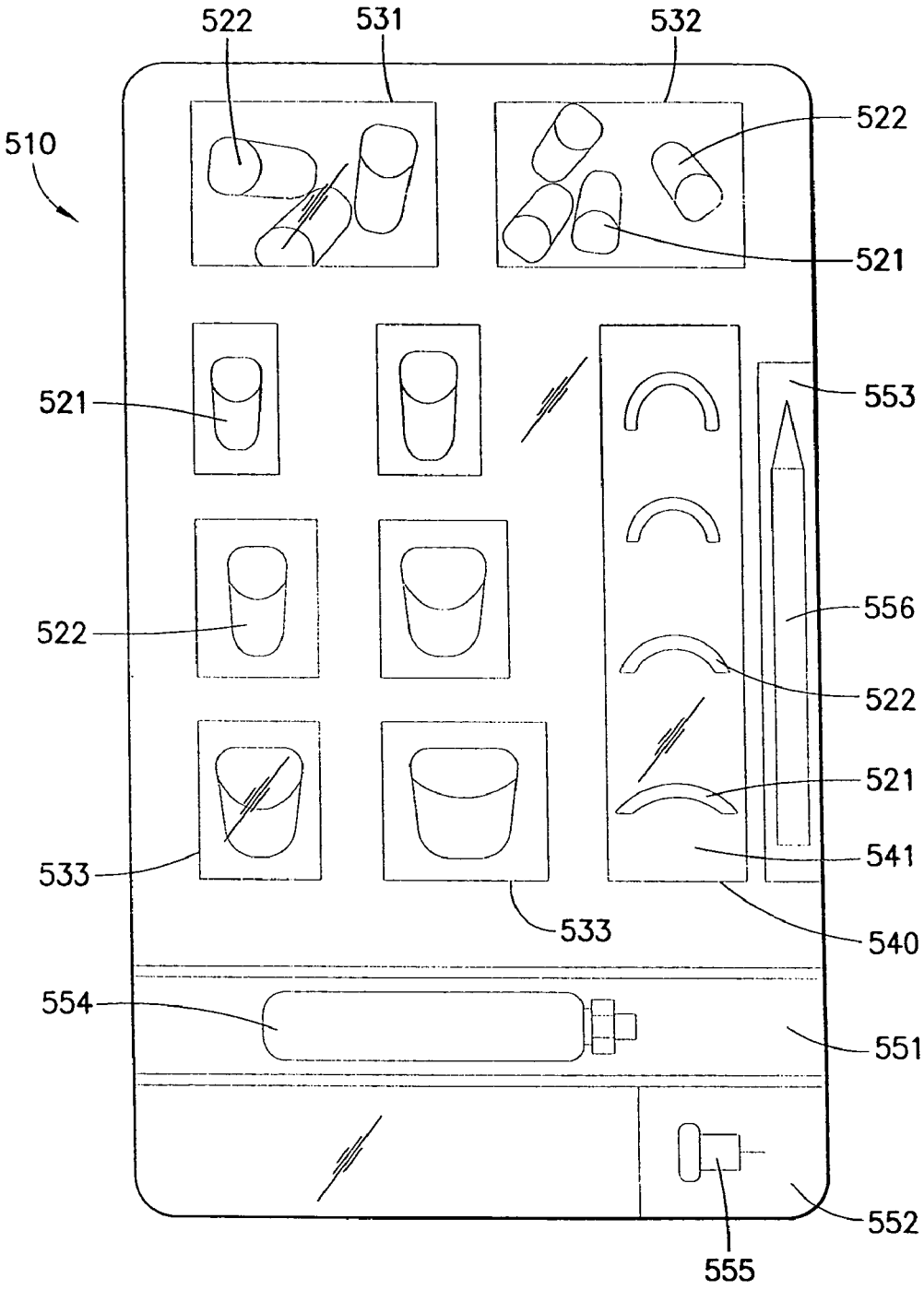
FIG. 5 is a plan view of one example of a packaging frame for artificial fingernails in accordance with the principles of the present invention.

FIG. 5 shows an exemplary embodiment of a packaging frame 510 for housing artificial nails of varying widths such that for each available width, nails having a plurality of arch heights in accordance with the principles of the present invention are available. Packaging frame 510 is preferably made from a translucent or transparent material such as plastic and preferably comprises several different compartments for storing artificial nails 521 and 522. As illustrated in FIG. 5, artificial nails 521 and 522 are artificial nails having a conventional arch height and a high-arch, respectively. The invention, however, is not limited in this manner. For example, artificial nails 522 may instead be artificial nails having a low arch height, or packaging frame 510 may house artificial nails having more than two arch heights.

Primary compartments 531 and 532 of packaging frame 510, for example, may contain loose nails 521 and 522. It should be understood that although artificial nails 521 and 522 are mixed together in primary compartments 531 and 532 of frame 510, they may, in accordance with other embodiments of the present invention, be segregated for easier identification by a user. For example, primary compartment 531 may contain only nails of conventional height 521, while primary compartment 532 may contain only high-arch nails 522.

Packaging frame 510 also comprises a plurality of display compartments 533 that are each designed to contain a nail 521 or 522. As shown in FIG. 5, display compartments 533 may be of different sizes for storing different size artificial nails (e.g., nails with smaller and larger widths and lengths), although the invention is not limited in this manner. Additionally, the depth of display compartments 533 may also be varied to better accommodate artificial nails having different arch heights. Preferably, one artificial nail 521 or 522 is placed in each of display compartments 533 such that a user can view the top or bottom of the artificial nail 521 or 522 therein from a top-side view or a bottom-side view (through a transparent or open portion of the package in which packaging frame 510 is inserted, as explained below), enabling the customer to examine the coloring and other features of the artificial nail 521 or 522.

FIG. 5 also shows a curvature-displaying compartment 540 for storing artificial nails 521 and/or artificial nails 522. Curvature displaying compartment 540 may include, for example, a sponge-like material 541 for retaining artificial nails 521 and/or 522 in a position substantially perpendicular to the artificial fingernails 521 and 522 located in display compartments 533 (i.e., if packaging frame 510 is placed flat on a horizontal surface, the nails in compartment 540 will be positioned to stick out in a direction substantially perpendicular to the surface). Sponge-like material 541 may comprise nail-receiving slits therein, for example, in order to retaining artificial nails 521 and 522 in their proper position following placement of artificial nails 521 and 522 into respective slits of the sponge-like material 541. Alternatively, other means for positioning artificial nails 521 and 522 in compartment 540 may be used in accordance with the principles of the present invention.

Packaging frame 510 preferably also includes compartments 551-553. Adhesive compartment 551 may hold a container of adhesive 554 (which may contain any suitable type of glue) to be used for applying artificial nails 521 and 522 to the user's natural fingernails. Assuming adhesive 554 requires the user to pierce a hole in the tip of adhesive container 554 prior to application, pin compartment 552 may be included in packaging frame 510 for retaining a push pin 555. A manicure stick, or cuticle stick 556, may also be provided for the user in optional stick compartment 553.

Figure 6:
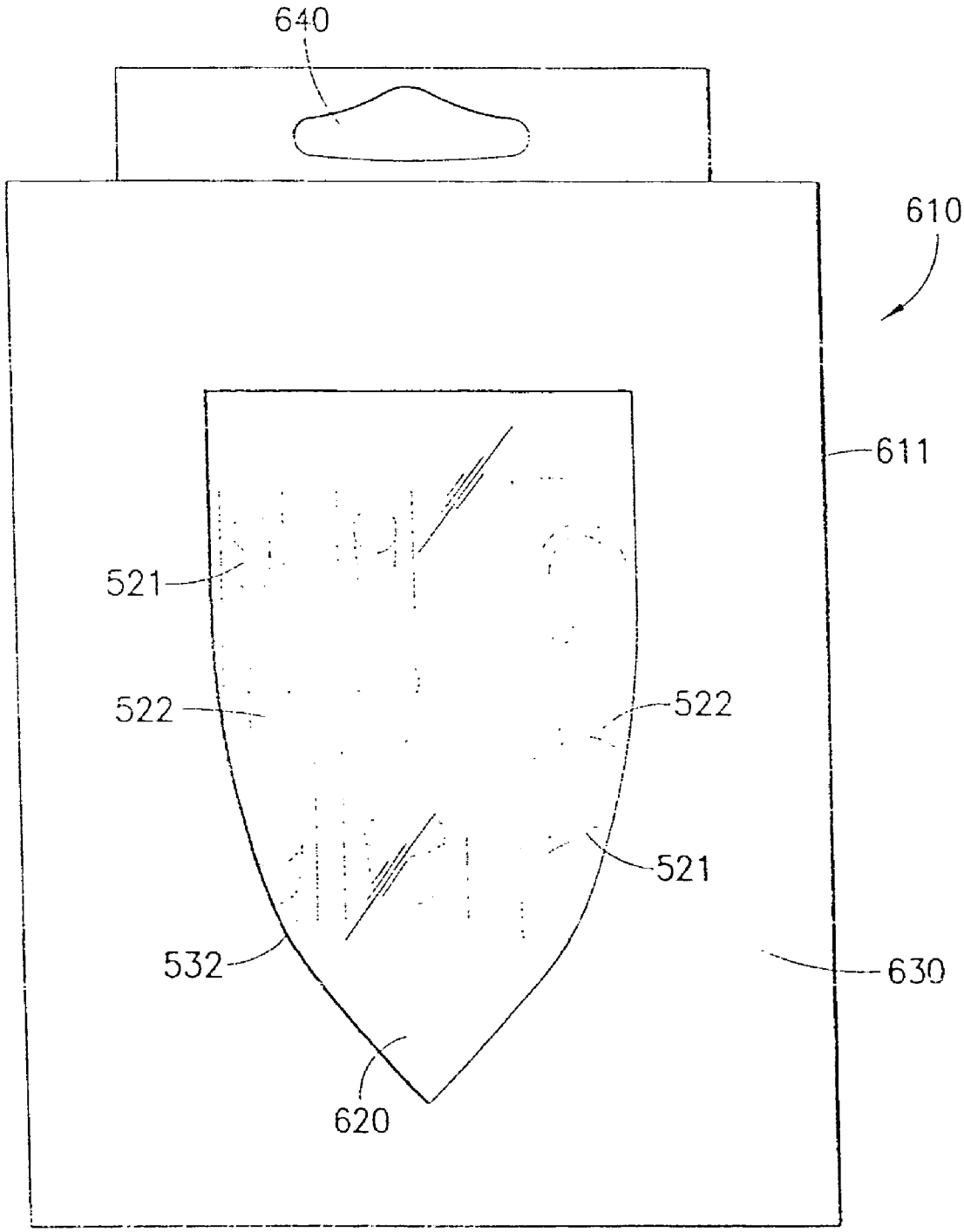
FIG. 6 is a plan view of one example of a package for artificial fingernails, including the packaging frame of FIG. 5, in accordance with the principles of the present invention.

FIG. 6 is a plan view of a package 610 that includes the packaging frame of FIG. 5. The exterior portion 611 of package 610 is a box that may be completely transparent, but preferably contains a transparent portion 620 and a non-transparent portion 630. Transparent portion 620 is designed to permit various items (e.g., a plurality of artificial nails 521 and 522) being housed within packaging frame 510 to be seen from the outside of package 610 by a consumer and may be merely an opening in the exterior portion 611. Moreover, while transparent portion 620 is shown to be of a particular size and shape, the invention is not limited in this manner. Both the size and shape of transparent portion 620 may be varied to allow a greater or lesser number of items from packaging frame 510 to be visible from the outside of package 610.

Although shown blank in FIG. 6, the non-transparent portion 630 of package 610 preferably carries descriptive information (e.g., a brand name, a list of contents, instructions for application, etc.) relating to the nails contained in package 610. Cutaway portion 640, meanwhile, may be included to facilitate the presentation of package 610 on sales display units conventionally found in retail stores.

With package 610, a user may readily inspect the various sizes, shapes and other features of the artificial nails 521 and 522 located therein. For example, the coloring, respective widths and other features of the artificial nails 521 and 522 in display compartments 533 may be seen through transparent portion 620 as illustrated in FIG. 6. Additionally, because the c-curves of artificial nails 521 and 522 are directly viewable as a result of the manner of placement of artificial nails 521 and 522 in curvature-displaying compartment 540, the respective arch heights of artificial nails 521 and 522 located in curvature-displaying compartment 540 may be directly viewed and compared by the user to the arch heights of the user's natural fingernails. In this manner, the user is able to make a more informed decision regarding the suitability for the user's natural fingernails of the enclosed artificial nails 521 and 522 located within package 610.

It should be understood by those skilled in the art that the present invention is not limited by the specific configurations described above. For example, it should be noted that although nails having three different arch heights are discussed above (i.e., conventional, low-arch and high-arch nails), and artificial fingernails 521 and 522 having two different arch heights are shown in package 610, the invention is not limited in this manner Rather, for example, artificial nails with only one arch height or with three or more different arch heights may be housed within package 610, and made viewable to a user in accordance with the principles of the present invention. Additionally, for example, artificial fingernails 521 and 522 may be stored in packaging frame 510 in manners other than those shown in FIG. 5, such as by connecting various such artificial fingernails 521 and 522 to a fingernail sprue (not shown). Moreover, the principles of the present invention can be applied to packages containing any suitable type artificial fingernails, including full-cover artificial nails and nail tips, for example. The scope of the present invention is not limited in any of these manners.

Figure 7:
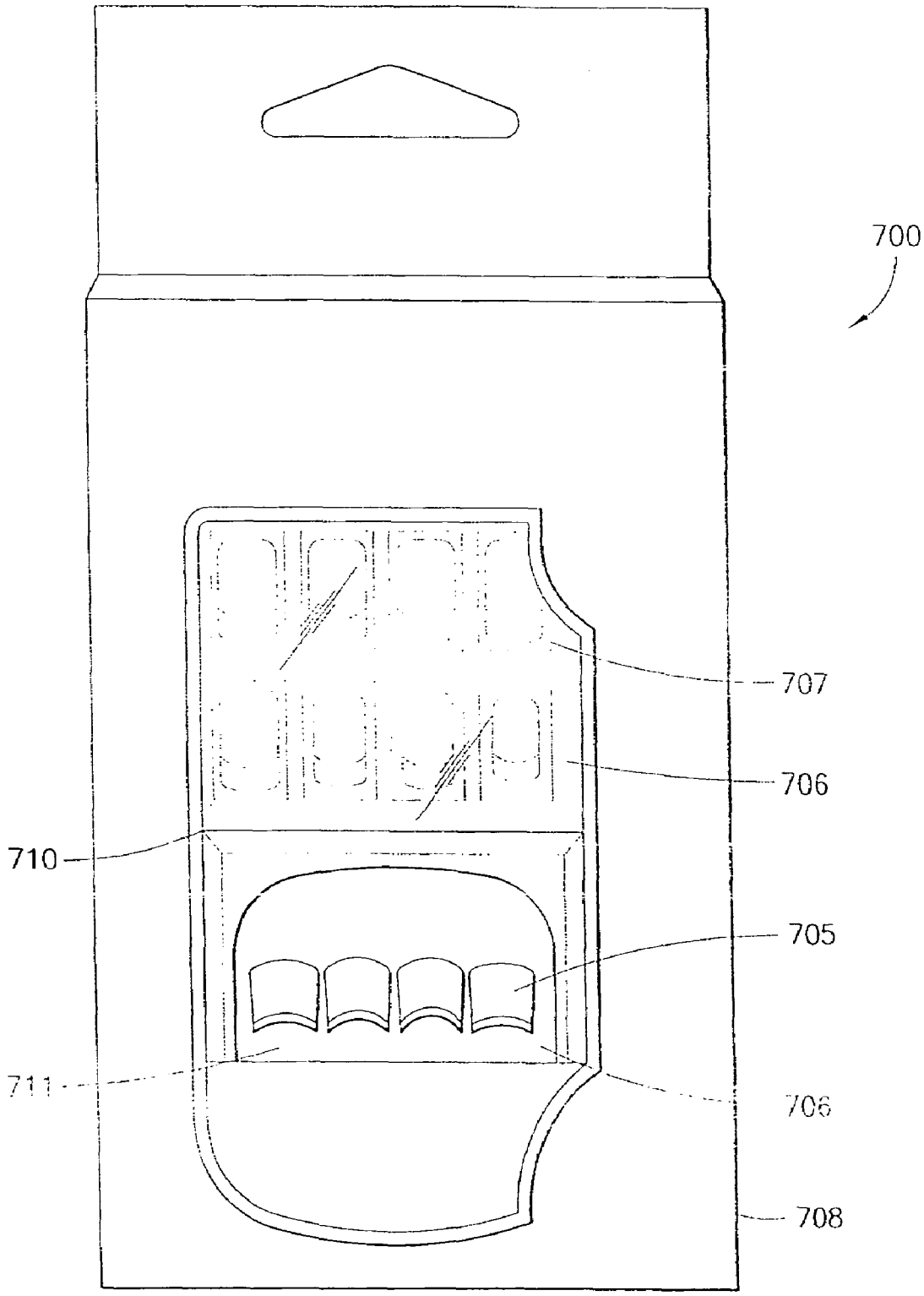
FIG. 7 is a plan view of another example of a package for artificial fingernails in accordance with the principles of the present invention.
Figure 8:
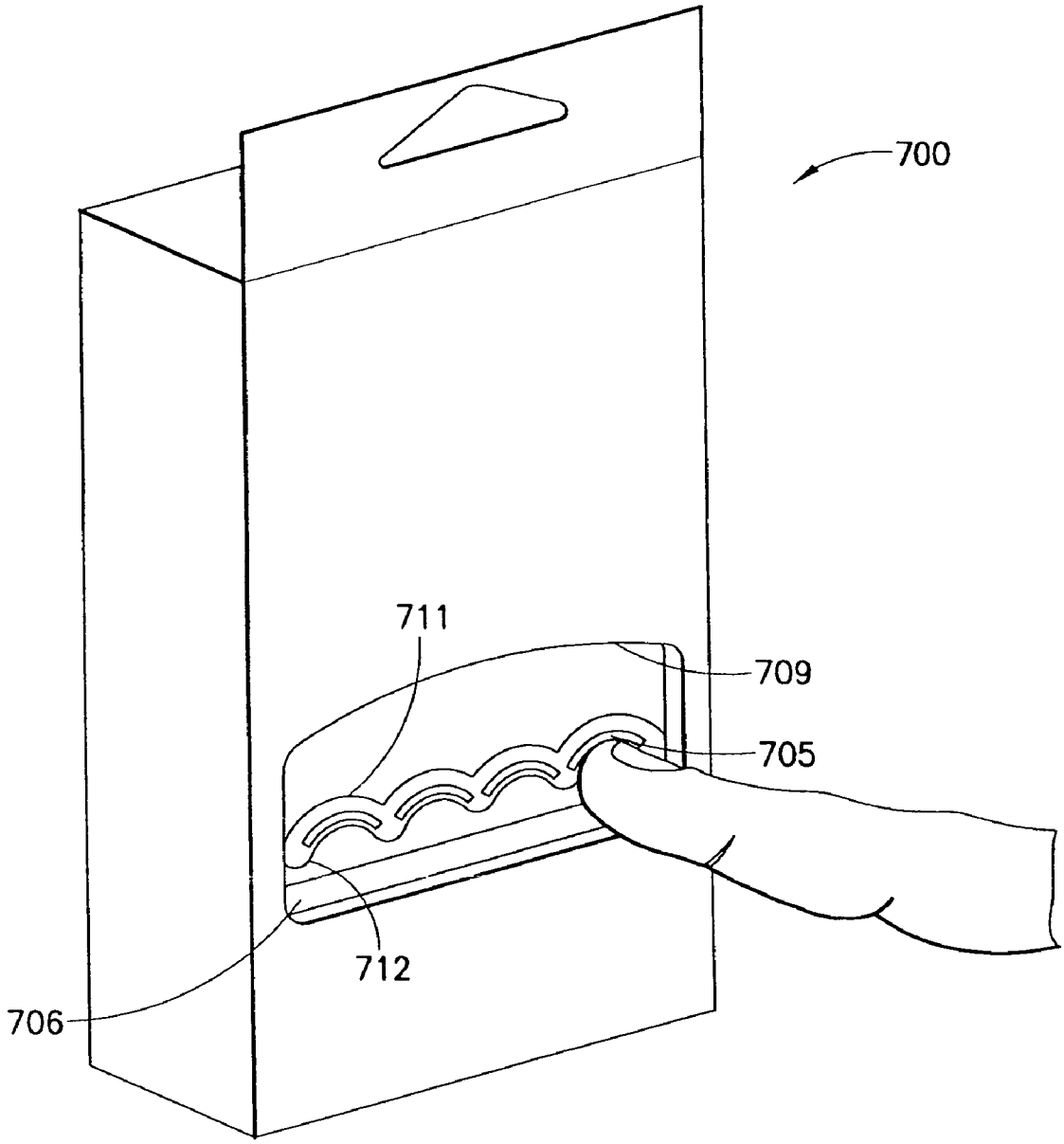
FIG. 8 is a rear perspective view of the package of FIG. 7 in accordance with the principles of the present invention.
Figure 9:
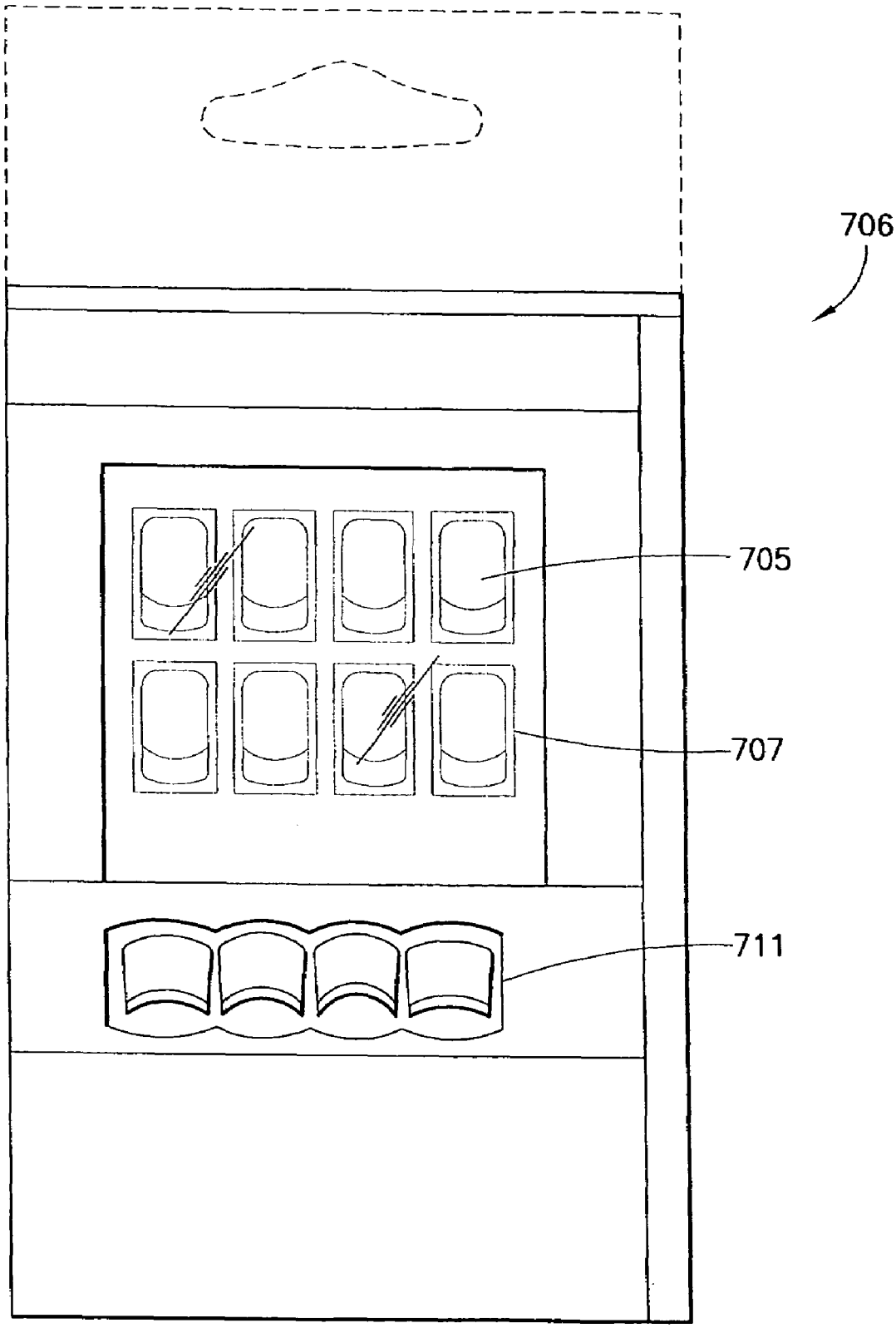
FIG. 9 is a plan view of the packaging frame partially shown in FIGS. 7 and 8.

FIGS. 7 and 8 show another embodiment in accordance with the teachings of the present invention. The front and rear of package 700 are shown in FIGS. 7 and 8 respectively.

As seen in FIG. 7, the artificial fingernails 705 are suspended and displayed in a packaging frame 706 which is preferably made of clear plastic and which is molded to include one or more nail display structures such as top-view display structures 707 and try-on display structures 711. These clear display structures 707 and 711 show the actual artificial fingernail 705 as it actually appears. Therefore, the potential buyer can see the actual color and design of the nail.

As best seen in FIG. 8, the package 700 is preferably designed so that a potential buyer can insert her finger through an opening or aperture 709 and underneath one or more of the artificial nails 705 that is held in place within the try-on display structure 711 of packaging frame 706 to "try on" the artificial nails 705 prior to purchase, in this way, it is possible for the buyer to summarily judge the fit, size, height, arch height, shape, length, color, pattern and any number of other variables associated with a displayed artificial fingernail 705.

The packaging frame 706 is dimensioned to fit securely within exterior portion, or box, 708, which forms the outer region of package 700. An opening or window 710 located on the front side of package 700 allows the packaging frame 706 to be viewed from the front. Box 708 is typically constructed of folded cardboard or rigid paper, but may be made of any suitable material and may take any suitable shape.

While FIG. 8 shows one opening 709 and one finger being inserted below one artificial nail 705, the present invention alternatively envisions single or multiple openings 709 and single or multiple corresponding try-on display structures 711 located at any suitable location on package 700. As shown in FIG. 8, one embodiment of the invention provides a large opening 709 in package 700 that enables the consumer to insert multiple fingers at once, if desired, to simultaneously assess the fit and appearance of multiple artificial nails 705 for multiple fingers.

In yet another embodiment of the present invention, the underside 712 of try-on display structure 711 is shaped to conform to the shape of artificial nails 705 so that when the potential buyer inserts her finger, the underside 712 approximates on the potential buyer's finger the size and shape of the artificial nails 705.

Persons skilled in the art should appreciate that the above-described embodiments of the present invention are presented for purposes of illustration and not of limitation.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described and/or suggested in connection with any disclosed form or embodiment of the invention may be incorporated in any other disclosed or described or suggested form or embodiment as a general matter of design choice. It is the intention, therefore, that the scope of this invention be limited only as indicated by the scope of the claims appended hereto.

What is claimed is:

1. A package for the display and sale of artificial fingernails, comprising:

a box having a front side and a back side;

a packaging frame within said box;

said packaging frame comprising a plurality of product-display structures, each of said product-display structures holding at least one fingernail;

said product-display structures comprising a try-on display structure having an underside facing a bottom of said at least one fingernail, said underside having a longitudinal length corresponding to a longitudinal length of said at least one fingernail, said longitudinal length of said underside extending at least partially from said back side to said front side of said box;

said front side of said box including a window portion;

said box having an opening on said back side, said opening being located adjacent to said try-on display structure and being arranged and dimensioned to allow an end of a customer's finger to be inserted through said opening and under said underside of said try-on display structure.

2. The package of claim 1, wherein the product-display structures are of at least two different sizes.

3. The package of claim 1, comprising a first group of product-display structures and a second group of product-display structures, wherein the structures in the first group are oriented perpendicular to the structures in the second group.

4. The package of claim 1, wherein the product-display structures are made of clear plastic.

5. The package of claim 1, wherein said box covers at least a portion of said packaging frame.

6. The package of claim 1, wherein a top side and a front edge of the at least one fingernail in said try-on display structure are viewable through said window portion on said front side such that a size of the at least one finger nail and characteristics of the arch of the at least one fingernail are observable through said window portion.

7. The package of claim 6, wherein said underside of said try-on display structure is formed to approximate on the customer's inserted finger, the size and shape of the at least one artificial nail held in said try-on display structure.

8. A retail package for display and sale of artificial fingernails comprising:

a box having a front side and a rear side;

a packaging frame within said box;

product-display structure within said box, wherein said product-display structure is dimensioned to hold an artificial fingernail for display and comprises an underside facing a bottom of said at least one fingernail, said underside having a longitudinal length corresponding to a longitudinal length of said at least one fingernail, said longitudinal length of said underside extending at least partially from said rear side to said front side of said box;

said box having an opening located adjacent to said product-display structure;

said opening being arranged and dimensioned to allow an end of a customer's finger to be inserted through said opening and under said underside of said product-display structure.

* * * * *